US012428923B1

(12) United States Patent
Driller et al.

(10) Patent No.: US 12,428,923 B1
(45) Date of Patent: Sep. 30, 2025

(54) DOWNHOLE SETTING TOOL WITH DUAL HYDRAULIC RELEASE

(71) Applicant: INNOVEX DOWNHOLE SOLUTIONS, INC., Humble, TX (US)

(72) Inventors: Brent Driller, Humble, TX (US); Graeme Thomas Marr, Aberdeenshire (GB); Callum Morrison, Humble, TX (US)

(73) Assignee: INNOVEX DOWNHOLE SOLUTIONS, INC., Humble, TX (US)

( * ) Notice: Subject to any disclaimer, the term of this patent is extended or adjusted under 35 U.S.C. 154(b) by 0 days.

(21) Appl. No.: 18/792,875

(22) Filed: Aug. 2, 2024

(51) Int. Cl.
*E21B 23/04* (2006.01)
*E21B 33/04* (2006.01)
*E21B 43/10* (2006.01)

(52) U.S. Cl.
CPC ..... *E21B 33/04* (2013.01); *E21B 43/105* (2013.01)

(58) Field of Classification Search
CPC ..... E21B 23/04; E21B 23/0413; E21B 33/04; E21B 43/105
See application file for complete search history.

(56) References Cited

U.S. PATENT DOCUMENTS

| | | | | |
|---|---|---|---|---|
| 8,393,401 | B2 * | 3/2013 | Yokley | E21B 43/10 166/208 |
| 10,767,429 | B2 * | 9/2020 | McGuire | E21B 34/142 |
| 11,753,906 | B2 * | 9/2023 | Gharesi | E21B 34/142 166/66.6 |
| 11,891,868 | B2 * | 2/2024 | Cullum | E21B 23/0413 |
| 2011/0114334 | A1 * | 5/2011 | Palacios | E21B 23/04 166/373 |

* cited by examiner

*Primary Examiner* — Matthew R Buck
(74) *Attorney, Agent, or Firm* — MH2 Technology Law Group, LLP

(57) ABSTRACT

A downhole tool includes a mandrel and a lower sleeve positioned at least partially within the mandrel. The lower sleeve defines a first seat that is configured to receive a first impediment. The first impediment being received within the first seat triggers a primary hydraulic release of the downhole tool from a second downhole tool in a wellbore. The downhole tool also includes an upper sleeve positioned at least partially within the mandrel. The upper sleeve defines a second seat that is configured to receive a second impediment. The upper sleeve is configured to move in a downward direction from a first upper sleeve position to a second upper sleeve position in response to the second impediment being received in the second seat, which triggers a secondary hydraulic release of the downhole tool from the second downhole tool in the event that the primary hydraulic release fails.

20 Claims, 11 Drawing Sheets

DOWNHOLE SETTING TOOL WITH DUAL HYDRAULIC RELEASE

BACKGROUND

A liner is a tubular member that is installed in a wellbore. The liner does not reach the surface. Rather, the liner hangs from a liner hanger that is installed in the wellbore. The liner hanger may be installed (e.g., set) in the wellbore using a downhole setting tool. A conventional downhole setting tool is configured to perform high-torque applications including drill-in and reaming applications. The conventional downhole setting tool is also able to rotate the liner during cementing applications.

The conventional downhole setting tool may set and then release the liner hanger hydraulically using a collet system and a drop ball. If that fails, the conventional setting tool may set and then release the liner hanger mechanically. However, when the liner is run in extended reach drilling (ERD) wellbore, there are limitations on the ability to release the liner hanger mechanically. Therefore, what is needed is an improved system and method for setting and/or releasing a downhole setting tool from a downhole tool (e.g., liner hanger system), particularly in ERD wellbores.

SUMMARY

A downhole tool is disclosed. The downhole tool includes a mandrel. The downhole tool also includes a lower sleeve positioned at least partially within the mandrel. The lower sleeve defines a first seat that is configured to receive a first impediment. The first impediment being received within the first seat triggers a primary hydraulic release of the downhole tool from a second downhole tool in a wellbore. The downhole tool also includes an upper sleeve positioned at least partially within the mandrel. The upper sleeve defines a second seat that is configured to receive a second impediment. The upper sleeve is configured to move in a downward direction from a first upper sleeve position to a second upper sleeve position in response to the second impediment being received in the second seat, which triggers a secondary hydraulic release of the downhole tool from the second downhole tool in the event that the primary hydraulic release fails.

A downhole tool that is configured to set a liner hanger system in a wellbore is also disclosed. The downhole tool includes a mandrel having an upper portion, an intermediate portion, and a lower portion. The downhole tool also includes a lower sleeve positioned at least partially within the lower portion of the mandrel. The lower sleeve defines a first seat that is configured to receive a first impediment. The first impediment being received within the first seat triggers a primary hydraulic release of the downhole tool from the liner hanger system. The downhole tool also includes an upper sleeve positioned at least partially within the intermediate portion of the mandrel. The upper sleeve defines a second seat that is configured to receive a second impediment. The upper sleeve is configured to move in a downward direction from a first upper sleeve position to a second upper sleeve position in response to the second impediment being received in the second seat, which triggers a secondary hydraulic release of the downhole tool from the liner hanger system in the event that the primary hydraulic release fails. The downhole tool also includes a support dog positioned at least partially around the upper sleeve. The support dog is configured to move from a first support dog position to a second support dog position in response to the upper sleeve moving from the first upper sleeve position to the second upper sleeve position. The downhole tool also includes a collet support positioned at least partially around the support dog. The collet support is configured to move from a first collet support position to a second collet support position in response to the support dog moving from the first support dog position to the second support dog position. The downhole tool also includes a collet positioned at least partially around the mandrel. The collet is configured to disengage with the liner hanger system in response to the collet support moving from the first collet support position to the second collet support position.

A method for operating a downhole tool is also disclosed. The method includes running the downhole tool into a wellbore. The downhole tool includes a mandrel, a lower sleeve positioned at least partially within the mandrel, and an upper sleeve positioned at least partially within the mandrel. The method also includes setting a second downhole tool in the wellbore using the downhole tool. The method also includes determining that a primary hydraulic release of the downhole tool from the second downhole tool has failed. The primary hydraulic release involves the lower sleeve. The method also includes causing the downhole tool to release from the second downhole tool via a secondary hydraulic release in response to determining that the primary hydraulic release has failed. The secondary hydraulic release involves the upper sleeve.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
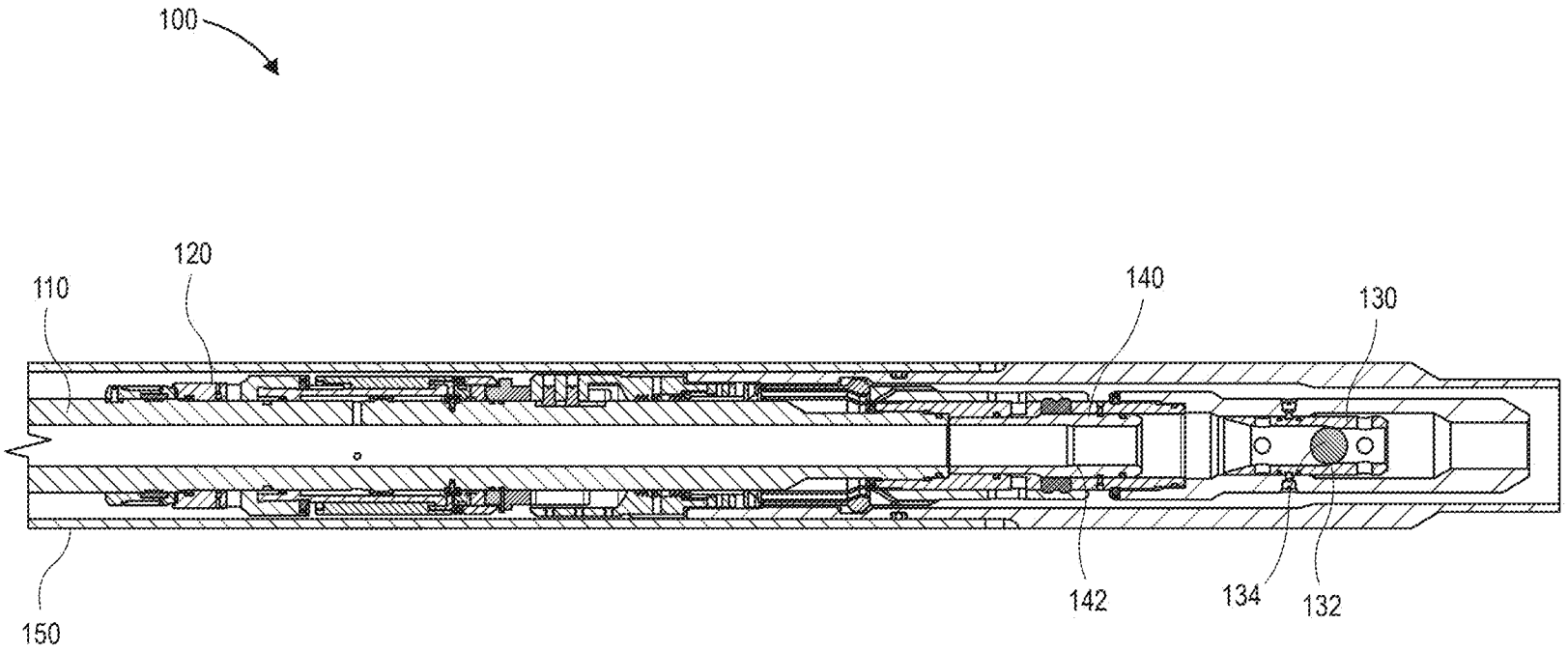
FIG. 1 illustrates a cross-sectional side view of a downhole tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a cross-sectional side view of a downhole tool 100, according to an embodiment. The downhole tool 100 may be or include a downhole setting tool that is configured to set another downhole tool (e.g., liner hanger system) in a wellbore. The liner hanger system may include a liner, a liner hanger, or both.

As described in greater detail below, the downhole tool 100 may include two or more release options to release the downhole tool 100 from the liner hanger system. More particularly, the downhole tool 100 may include a primary hydraulic release option and a secondary hydraulic release option. As described below, the secondary hydraulic release option may be triggered upon failure of the primary hydraulic release option. In one embodiment, the downhole tool 100 may also include a mechanical release option.

The downhole tool 100 may include an inner portion 110, referred to as a mandrel. The downhole tool 100 may also include an outer portion 120, referred to as an outer sleeve. The downhole tool 100 may also include a first inner sleeve (also referred to as a lower sleeve) 130 that is positioned in the mandrel 110. The lower sleeve 130 defines a first seat 132 therein that is configured to receive a first impediment (e.g., ball or dart) 134. The downhole tool 100 may also include a second inner sleeve (also referred to as an upper sleeve) 140 that is positioned in the mandrel 110. The upper sleeve 140 defines a second seat 142 therein that is configured to receive a second impediment (e.g., ball or dart). The downhole tool 100 may be positioned at least partially within another downhole tool (e.g., a liner hanger system) 150 in a wellbore.

Figure 2:
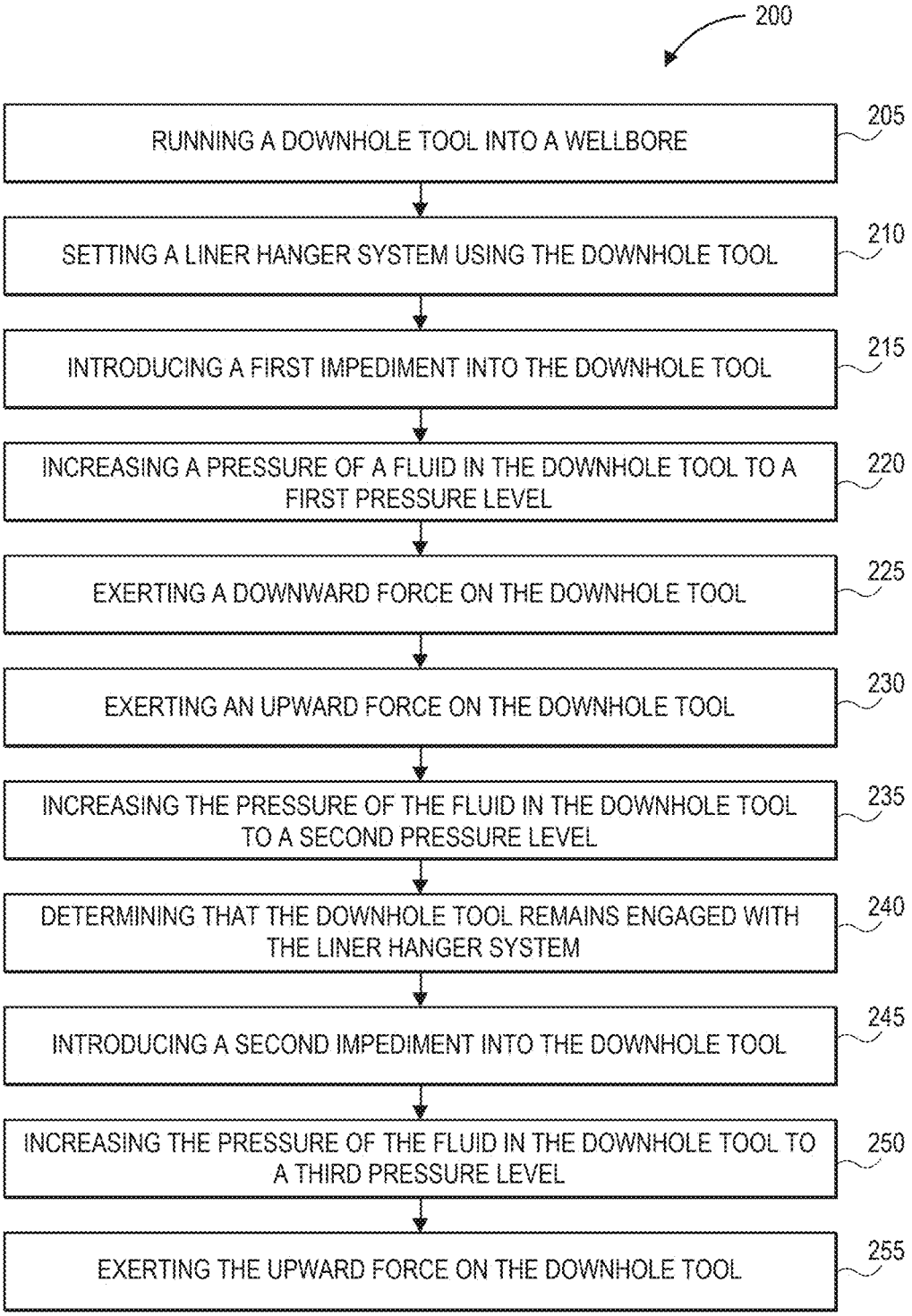
FIG. 2 illustrates a flowchart of a method for operating the downhole tool, according to an embodiment.

FIG. 2 illustrates a flowchart of a method 200 for operating the downhole tool 100, according to an embodiment. An illustrative order of the method 200 is provided below; however, one or more steps of the method 200 may be performed in a different order, simultaneously, repeated, or omitted.

Figure 3:
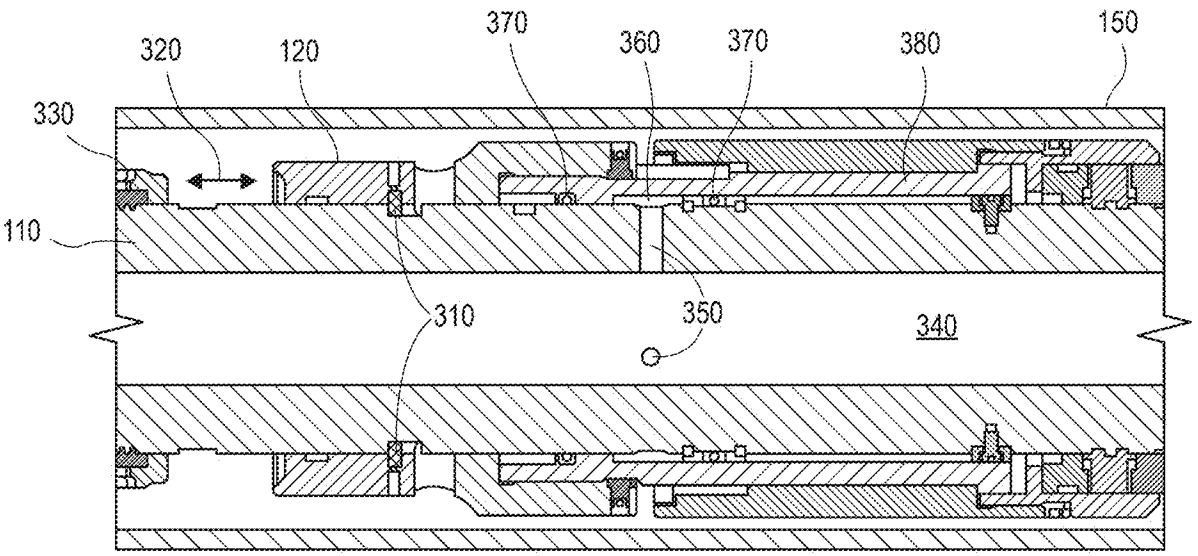
FIG. 3 illustrates an enlarged portion of the downhole tool showing an inner portion (e.g., a mandrel) of the downhole tool coupled to an outer portion (e.g., an outer sleeve) of the downhole tool with shear elements, according to an embodiment.

The method 200 may include running the downhole tool 100 into a wellbore, as at 205. The downhole tool 100 may be run in a first (e.g., run-in) state. In the run-in state, the mandrel 110 may be coupled to the outer sleeve 120 via one or more first shear elements (e.g., screws) 310. This is shown in FIG. 3. The first shear elements 310 may prevent relative (e.g., axial and/or rotational) movement between the mandrel 110 and the outer sleeve 120. Although not shown in FIG. 3, in the run-in state, the lower sleeve 130 may be coupled to the mandrel 110 via one or more second shear elements (e.g., screws), and the upper sleeve 140 may be coupled to the mandrel 110 via one or more third shear elements (e.g., screws). As also shown in FIG. 3, in the run-in state, an axial gap 320 may be present between the outer sleeve 120 and a stop ring 330, which is positioned above the outer sleeve 120.

The method 200 may also include setting the liner hanger system 150 using the downhole tool 100, as at 210. More particularly, once the downhole tool 100 is run into the wellbore, it may be used to set the liner hanger system 150 in the wellbore. This may include hanging the liner from the liner hanger, rotating the liner, performing a cementing operation, or a combination thereof.

Once the liner hanger system 150 is set, the downhole tool 100 may be released from the liner hanger system 150. Below, a primary hydraulic release and a secondary hydraulic release are described. The secondary hydraulic release may be used to release the downhole tool 100 from the liner hanger system 150 in the event that the primary hydraulic release fails.

Primary Hydraulic Release

The method 200 may also include introducing the first impediment (e.g., ball) 134 into the downhole tool 100, as at 215. More particularly, the first impediment 134 may be dropped into the wellbore from the surface and may flow through the bore of the downhole tool 100 (e.g., the mandrel 110) until it lands on the first seat 132 in the lower sleeve 130.

The method 200 may also include increasing a pressure of a fluid in the downhole tool 100 to a first pressure level, as at 220. More particularly, with the first impediment 134 blocking fluid flow through the bore, a pump at the surface may increase a pressure of the fluid in the bore 340 of the mandrel 110. As shown in FIG. 3, the mandrel 110 may define one or more radial ports 350 that provide a path of fluid communication between the bore 340 and an annular chamber 360. The chamber 360 may be defined radially between the mandrel 110 and the outer sleeve 120. Seals 370 may be positioned on opposing axial sides of the chamber 360 to help prevent the fluid from leaking out of the chamber 360.

Figure 4:
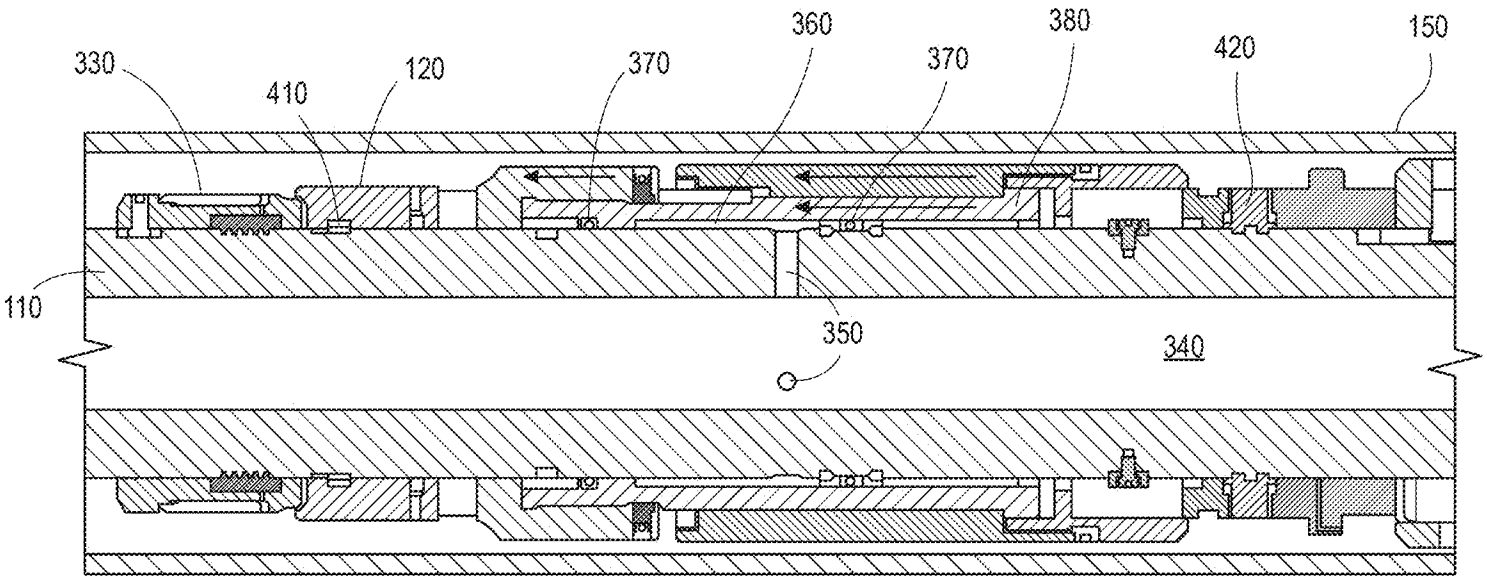
FIG. 4 illustrates an enlarged portion of the downhole tool showing the outer sleeve moving upward with respect to the mandrel, according to an embodiment.

The outer sleeve 120 may include a piston 380. The increased pressure may be communicated from the bore 340, through the ports 350, into the chamber 360 and exert a force on the piston 380 that moves the outer sleeve 120 in an upward direction. This is shown in FIG. 4. The outer sleeve 120 moving in the upward direction (to the left in FIG. 4) may cause the outer sleeve 120 to contact the stop ring 330, thereby eliminating the axial gap 320.

At this point, the outer sleeve 120 may be prevented from moving back in the downward direction (to the right in FIG. 4). More particularly, the outer sleeve 120 may also include a latch ring 410 on an inner surface thereof. When the outer sleeve 120 is proximate to and/or contacting the stop ring 330, the latch ring 410 may engage a groove on an outer surface of the mandrel 110, which may prevent the outer sleeve 120 from moving in the downward direction with respect to the mandrel 110.

The downhole tool 100 may include one or more release dogs 420 that prevent the mandrel 110 from moving in the upward direction together with the outer sleeve 120. The release dogs 420 may include one or more protrusions that extend radially inward and engage with the outer surface of the mandrel 110. When engaged, the release dogs 420 may prevent the mandrel 110 from moving in the upward direction.

Figure 5:
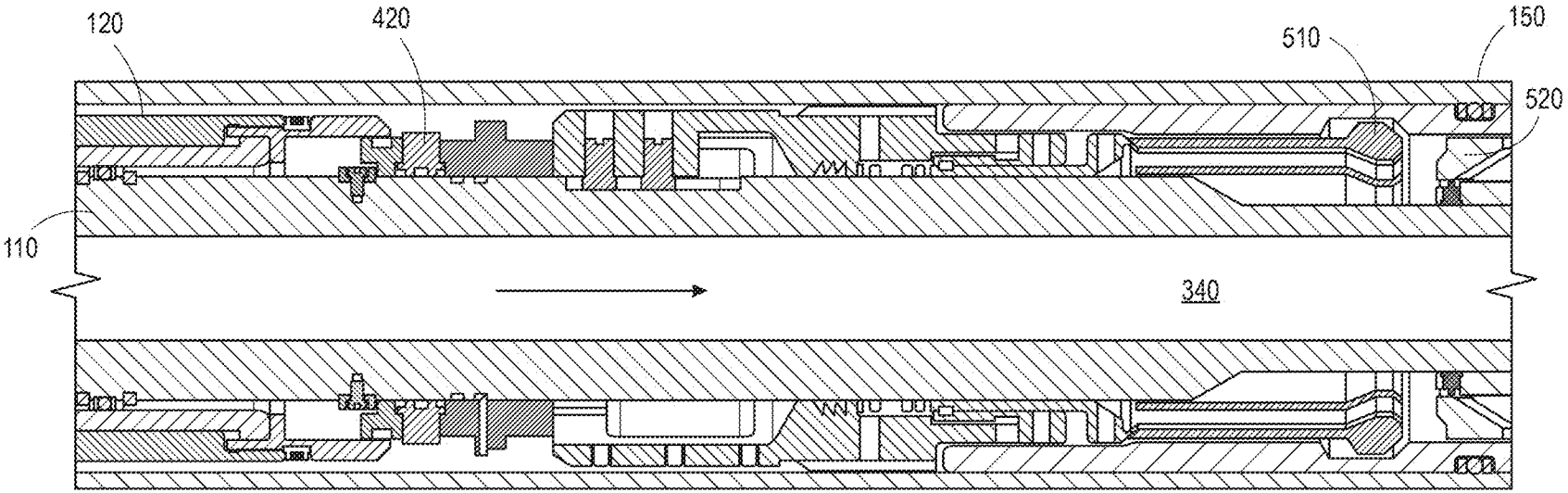
FIG. 5 illustrates an enlarged portion of the downhole tool showing the mandrel moving downward with respect to the outer sleeve, according to an embodiment.

The method 200 may also include exerting a downward force on the downhole tool 100, as at 225. This may be referred to as setting down weight on the downhole tool 100. More particularly, at the surface, a downward force may be exerted on the mandrel 110. The downward force may cause the release dogs 420 to move radially outward and disengage with the mandrel 110. Once disengaged, the downward force may cause the mandrel 110 to move in the downward direction with respect to the outer sleeve 120. This is shown in FIG. 5.

The downhole tool 100 may also include collets 510 and collet supports 520. The collets 510 and collet supports 520 may both be positioned radially outward from the mandrel 110. The collet supports 520 may be coupled to and move together with the mandrel 110 (e.g., in the downward direction); however, the collets 510 may remain (e.g., axially) stationary while the mandrel 110 and collet supports 520 move. Prior to the mandrel 110 and the collet supports 520 moving in the downward direction, the collet supports 520 may be in contact with the collets 510 and prevent the collets 510 from deflecting radially inward. As a result, the collets 510 may remain engaged with the liner hanger system 150. More particularly, the collets 510 may be positioned at least partially within a groove in an inner surface of the liner hanger system 150. The engagement between the collets 510 and the liner hanger system 150 may prevent the downhole tool 100 from releasing with the liner hanger system 150 and being pulled out of the wellbore and back to the surface. However, once the mandrel 110 and the collet supports 520 move in the downward direction, as shown in FIG. 5, the collet supports 520 no longer contact the collets 510 and prevent the collets 510 from deflecting radially inward.

The method 200 may also include exerting an upward force on the downhole tool 100, as at 230. With the collet supports 520 no longer contacting the collets 510, the upward force may cause the collets 510 to deflect radially inward and thus disengage from the liner hanger system 150. This may release the downhole tool 100 from the liner hanger system 150.

The method 200 may also include increasing the pressure of the fluid in the downhole tool 100 to a second pressure level, as at 235. More particularly, with the first impediment 134 still blocking fluid flow through the bore 340, the pump at the surface may increase the pressure of the fluid in the bore 340 of the mandrel 110. The second pressure level may be greater than the first pressure level. The pressure may be increased after the upward force is exerted, the collets 510 deflect radially inward, and/or the downhole tool 100 releases from the liner hanger system 150.

Figure 6:
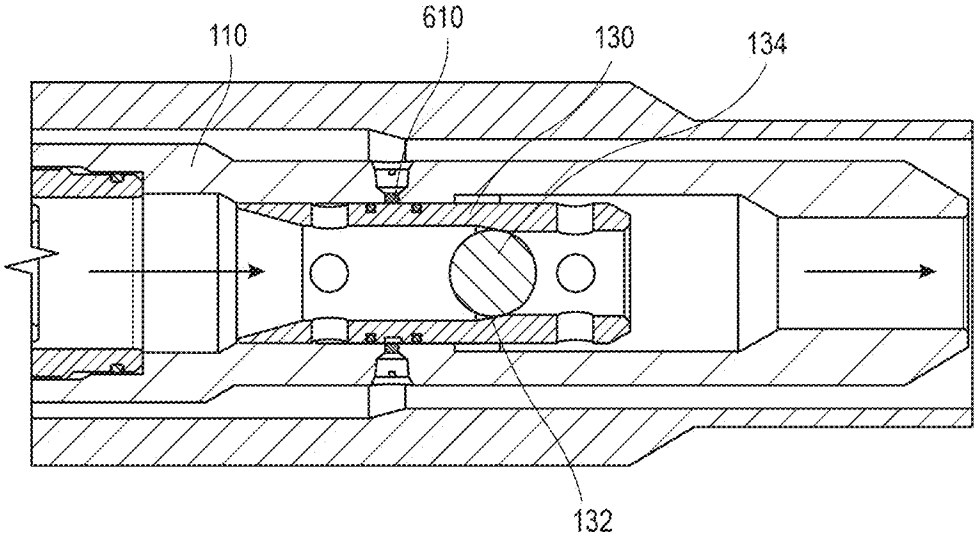
FIG. 6 illustrates an enlarged portion of the downhole tool showing a lower sleeve (including a first ball seat) of the downhole tool coupled to the mandrel with shear elements, according to an embodiment.
Figure 7:
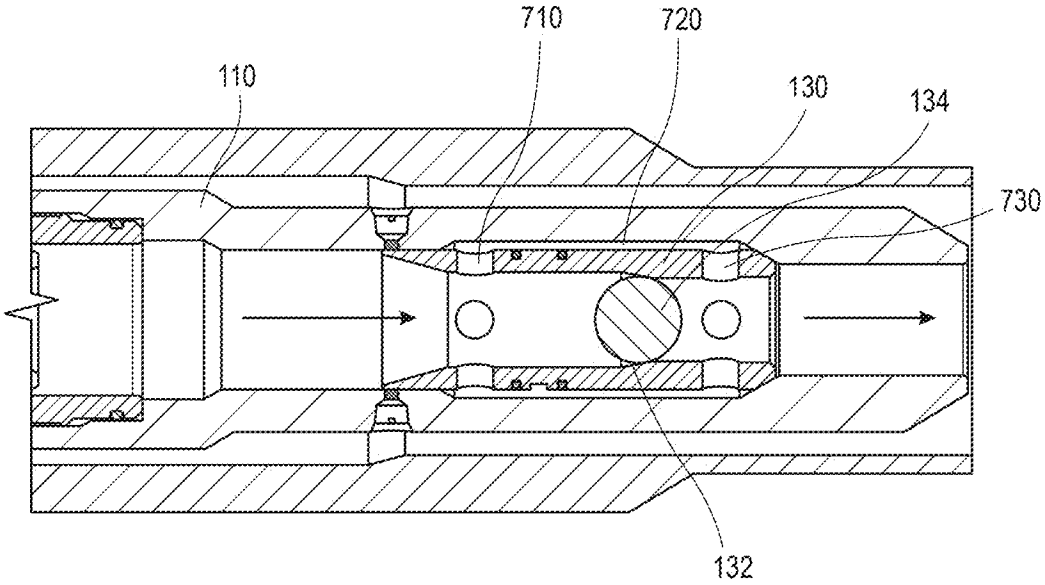
FIG. 7 illustrates an enlarged portion of the downhole tool showing the lower sleeve moving downward with respect to the mandrel after the shear elements shear, according to an embodiment.

In response to the pressure reaching the second pressure level, the second shear elements 610 may shear, allowing the lower sleeve 130 to move from a first position (FIG. 6) to a second position (FIG. 7). In the first position, fluid is prevented from flowing through the bore 340 by the lower sleeve 130 and the first impediment 134 therein. However, once the lower sleeve 130 moves in the downward direction (to the right in FIG. 7) from the first position to the second position, fluid flow may be reestablished through the bore 340. More particularly, the fluid may flow from an upstream portion of the bore 340 through first (e.g., upper) radial ports 710 in the lower sleeve 130 into an annulus 720 that is formed radially between the mandrel 110 and the lower sleeve 130. The fluid may then flow from the annulus 720 through second (e.g., lower) radial ports 730 and into a downstream portion of the bore 340. Reestablishing the flow through the bore 340 may allow for circulation and/or draining of the fluid when the downhole tool 100 is tripped out of the wellbore. The continued upward force (from step 225) may then pull/trip the downhole tool 100 out of the wellbore and to the surface.

Secondary Hydraulic Release

In one embodiment, the method 200 may include determining that the downhole tool 100 remains engaged with the liner hanger system 150, as at 240. In other words, this may include determining that the downhole tool 100 has not released from the liner hanger system 150 (e.g., due to the primary hydraulic release failing). The primary hydraulic release may fail because the collet supports 520 fail to move out of contact with the collets 510, the collets 510 fail to deflect radially inward to disengage with the liner hanger system 150, or both. The determination may include an inability to pull the downhole tool 100 back to the surface.

Figure 8:
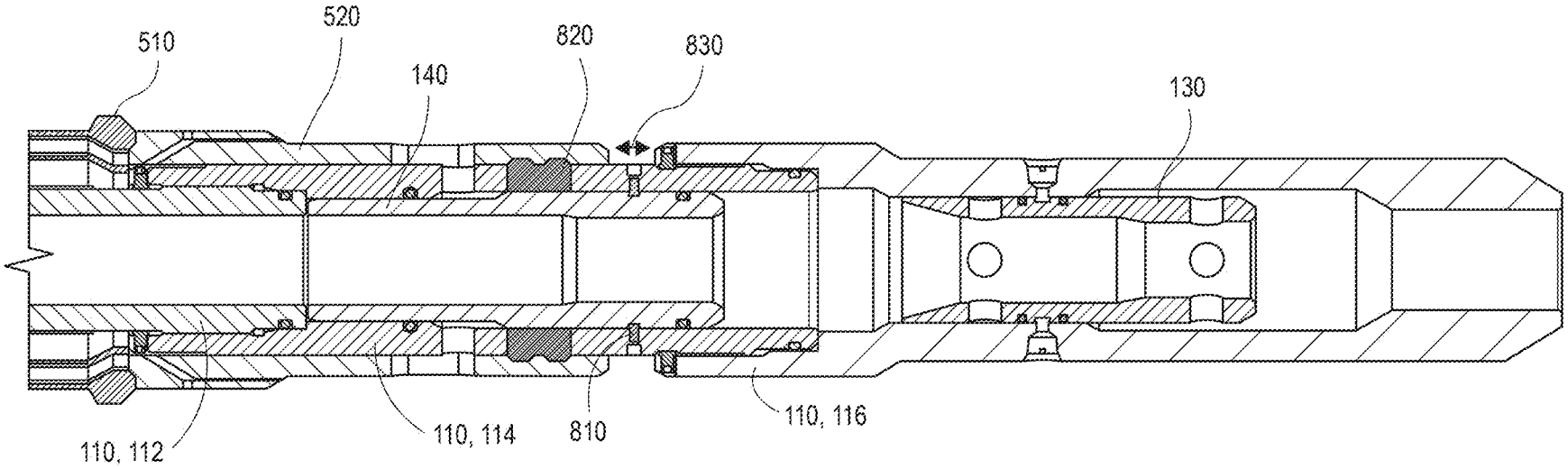
FIG. 8 illustrates an enlarged portion of the downhole tool showing an upper sleeve (including a second ball seat) of the downhole tool coupled to the mandrel with shear elements, according to an embodiment.
Figure 9:
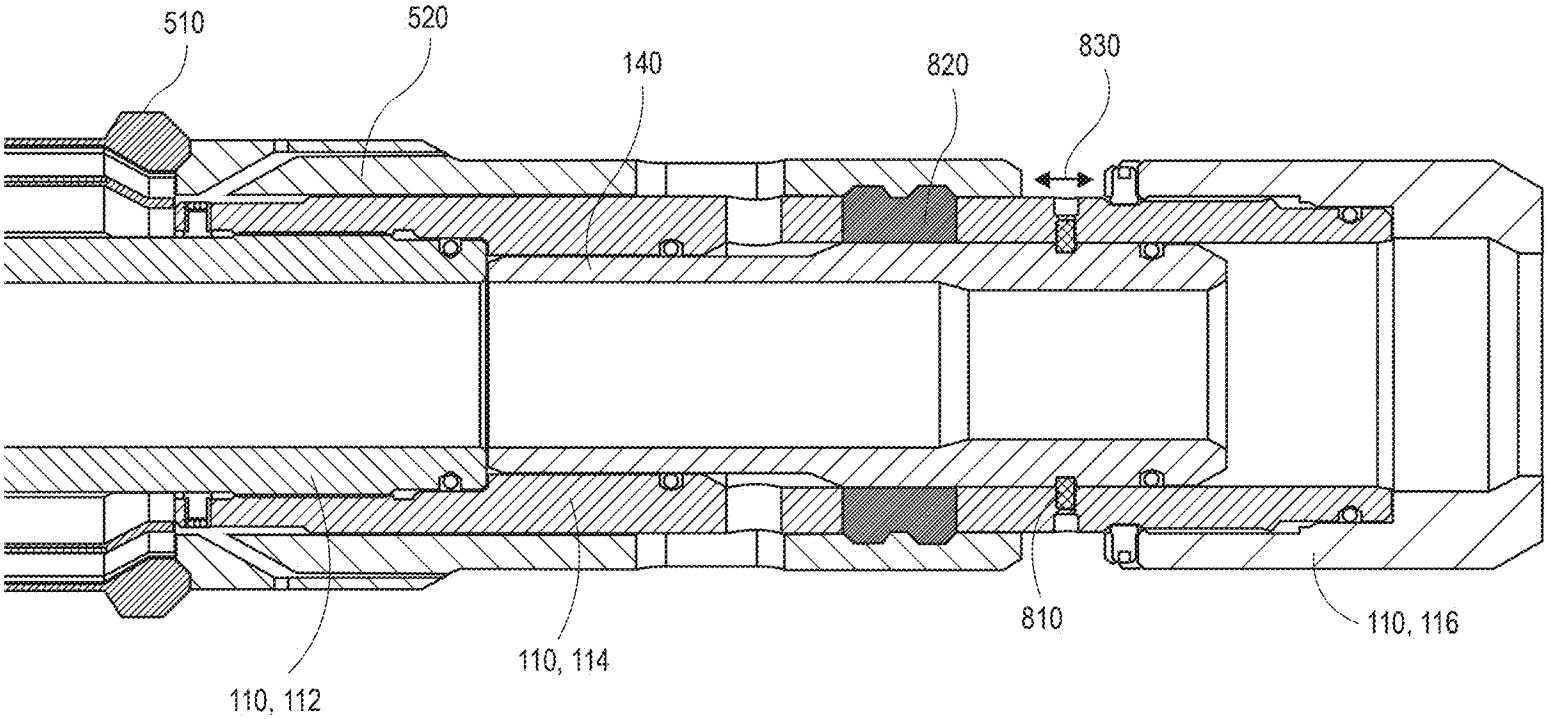
FIG. 9 illustrates another enlarged portion of the downhole tool showing the upper sleeve of the downhole tool coupled to the mandrel with shear elements, according to an embodiment.

At the time that it is determined that the primary hydraulic release has failed, the upper sleeve 140 may still be in the first (e.g., run-in) state. This is shown in FIGS. 8 and 9. In the run-in state, the upper sleeve 140 may be coupled to the mandrel 110 via one or more third shear elements 810. The mandrel 110 may include an upper portion/sub 112, an intermediate portion/sub 114, and a lower portion/sub 116. The upper sleeve 140 may be coupled to and/or positioned within the intermediate portion 114.

The downhole tool 100 may also include one or more support dogs 820 that prevent the collet support 520 from moving in the downward direction with respect to the mandrel 110 (e.g., the intermediate portion 114). The support dogs 820 may extend (e.g., radially) through the mandrel 110 (e.g., the intermediate portion 114). The support dogs 820 may include one or more protrusions that extend radially outward and engage with (e.g., grooves in) the inner surface of the collet support 520. When engaged, the support dogs 820 may prevent the collet support 520 from moving in the downward direction. As such, an axial gap 830 may be present between a lower surface of the collet support 520 and an upper surface of the lower portion 116 of the mandrel 110.

Figure 10:
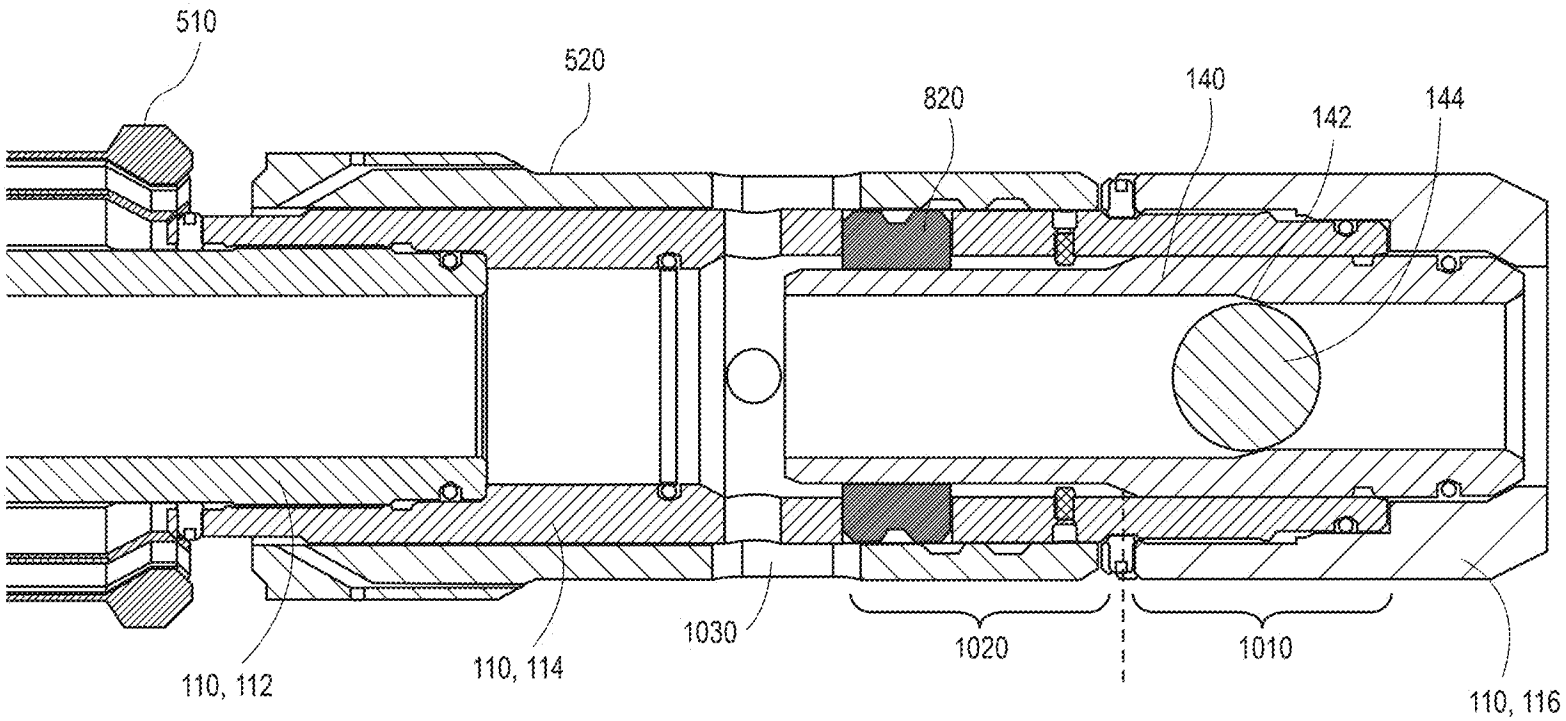
FIG. 10 illustrates an enlarged portion of the downhole tool showing the upper sleeve moving downward with respect to the mandrel after the shear elements shear, according to an embodiment.

In response to determining that the downhole tool 100 remains engaged with the liner hanger system 150, the method 200 may also include introducing a second impediment (e.g., ball) 144 into the downhole tool 100, as at 245. More particularly, the second impediment 144 may be dropped into the wellbore from the surface and may flow through the bore of the downhole tool 100 until it lands on the second seat 142 in the upper sleeve 140. This is shown in FIG. 10.

The method 200 may also include increasing the pressure of the fluid in the downhole tool 100 to a third pressure level, as at 250. The third pressure level may be greater than or less than the first pressure level and/or the second pressure level. More particularly, with the second impediment 144 blocking fluid flow through the bore, the pump at the surface may increase the pressure of the fluid in the bore 340 of the mandrel 110. In response to this increased pressure, the third shear elements 810 (see FIGS. 8 and 9) may shear, allowing the increased pressure to move the upper sleeve 140 and the second impediment 144 in the downward direction with respect to the mandrel 110 from a first position (FIGS. 8 and 9) to a second position (FIG. 10).

The outer surface of the second upper 140 may include a first (e.g., lower) portion 1010 and a second (e.g., upper) portion 1020. The lower portion 1010 may have a larger outer diameter than the upper portion 1020. The support dogs 820 may be aligned with the first portion 1010 when the upper sleeve 140 is in the first position (FIGS. 8 and 9), and the support dogs 820 may become aligned with the second portion 1020 when the upper sleeve 140 is in the second position (FIG. 10). When aligned with the second portion 1020, the support dogs 820 may be permitted to move radially inward such that they no longer engage the (grooves in the) inner surface of the collet support 520.

The method 200 may also include (re-)exerting the upward force on the downhole tool 100, as at 255. This may generate contact between the collets 510 and the liner hanger system 150, which may cause the collets 510 to deflect radially inward and thus disengage from the liner hanger system 150. This may release the downhole tool 100 from the liner hanger system 150. As the collets 510 deflect radially inward, they may push the collet support 520 in the downward direction, which may cause the collet support 520 to contact the lower portion 116 of the mandrel 110, thereby eliminating the axial gap 830.

The movement of the collet support in the downward direction may reestablish the flow through the bore 340 (e.g., via flow bypass ports 1030), which may allow for circulation and/or draining of the fluid when the downhole tool 100 is tripped out of the wellbore. The continued upward force (from step 255) may then pull/trip the downhole tool 100 out of the wellbore and to the surface.

Mechanical Release

The downhole tool 100 may also include a mechanical release (e.g., a third release option in addition to the primary and secondary hydraulic release options. The mechanical release may be performed by rotating the downhole tool (e.g., the mandrel 110). More particularly, the mandrel 110 may be rotated/torqued in a left-hand direction. Following the rotation, a downward force may be exerted on the downhole tool (e.g., the mandrel 110). This may generate contact between the collets 510 and the liner hanger system 150, which may cause the collets 510 to deflect radially inward and thus disengage from the liner hanger system 150. This may release the downhole tool 100 from the liner hanger system 150.

The mechanical release may be performed before or after the primary hydraulic release and/or the secondary hydraulic release. In one example, the mechanical release may be performed first, followed by the primary hydraulic release (e.g., if the mechanical release fails), followed by the secondary hydraulic release (e.g., if the primary hydraulic release fails). In another example, the primary hydraulic release may be performed first, followed by the mechanical release (e.g., if the primary hydraulic release fails), followed by the secondary hydraulic release (e.g., if the mechanical release fails). Alternatively, the mechanical release may not be used at all because the secondary release disengages the downhole tool 100 from the liner hanger system 150 (e.g., if the primary hydraulic release fails), as described herein.

Figure 11:
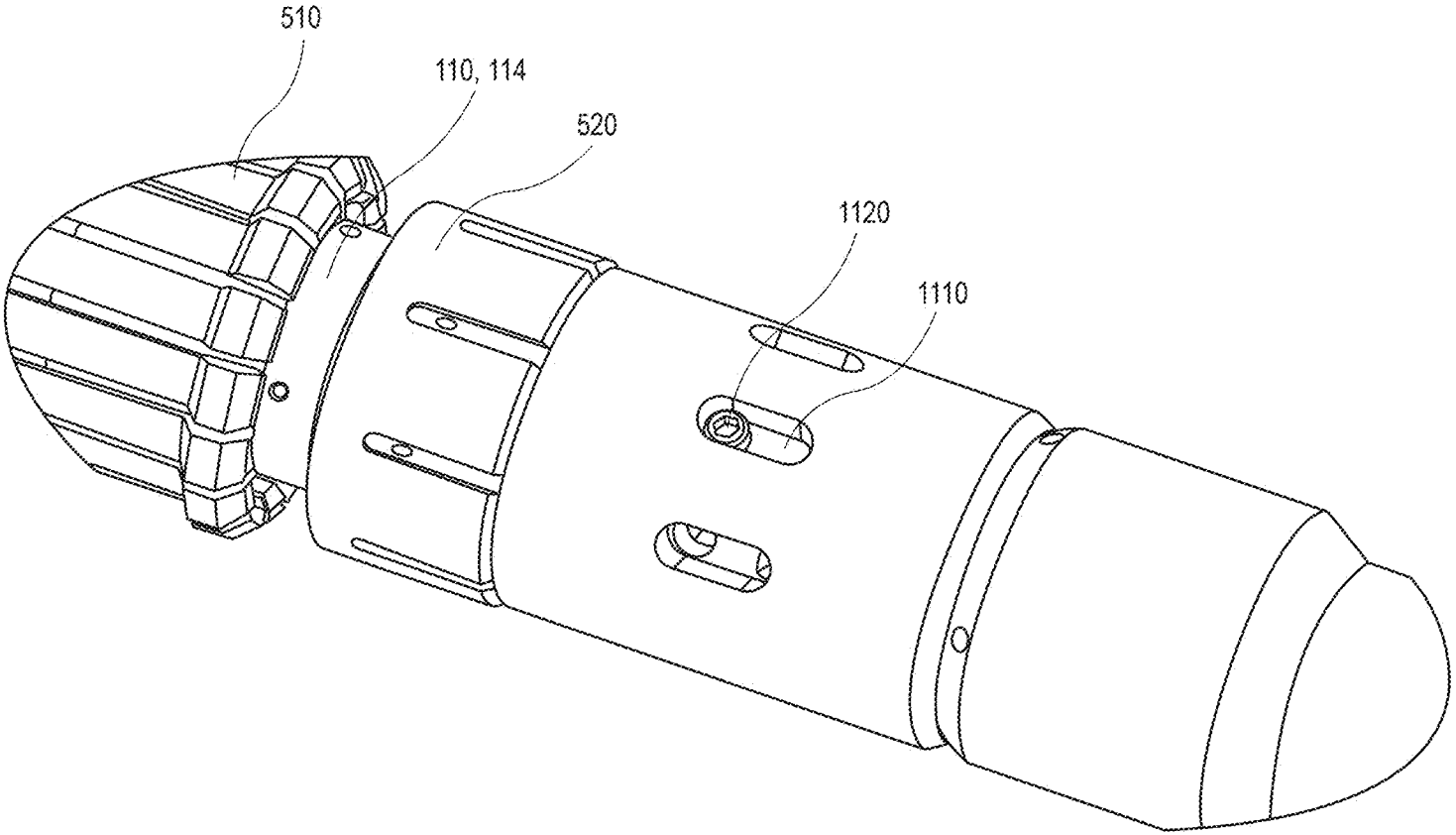
FIG. 11 illustrates a perspective view of a portion of the downhole tool showing a slot with an alignment screw therein, according to an embodiment.

FIG. 11 illustrates a perspective view of a portion of the downhole tool 100 showing a slot 1110 with an alignment screw 1120 therein, according to an embodiment. The collet support 520 may define the slot 1110, which may extend in an axial direction. The alignment screw 1120 may extend radially outward from the mandrel 110 (e.g., the intermediate portion 114) at least partially into/through the slot 1110. The positioning of the screw 1120 within the slot 1110 may allow the collet support 520 to move axially with respect to the mandrel 110 (e.g., the intermediate portion 114) while preventing the collet support 520 from rotating with respect to the mandrel 110 (e.g., the intermediate portion 114). In one embodiment, a plurality of slots 1110 and/or screws 1120 may be utilized, and they may be circumferentially offset from one another.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a mandrel;

a lower sleeve positioned at least partially within the mandrel, wherein the lower sleeve defines a first seat that is configured to receive a first impediment, and wherein the first impediment being received within the first seat triggers a primary hydraulic release of the downhole tool from a second downhole tool in a wellbore;

an upper sleeve positioned at least partially within the mandrel, wherein the upper sleeve defines a second seat that is configured to receive a second impediment, wherein the upper sleeve is configured to move in a downward direction from a first upper sleeve position to a second upper sleeve position in response to the second impediment being received in the second seat, which triggers a secondary hydraulic release of the downhole tool from the second downhole tool in the event that the primary hydraulic release fails; and a collet, wherein the primary hydraulic release and the secondary hydraulic release both attempt to cause the collet to disengage with the second down hole tool, thereby releasing the downhole tool from the second downhole tool in the wellbore.

2. The downhole tool of claim 1, wherein the mandrel comprises an upper portion, an intermediate portion, and a lower portion, and wherein the lower sleeve is positioned at least partially within the lower portion of the mandrel.

3. The downhole tool of claim 2, wherein the upper sleeve is positioned at least partially within the intermediate portion of the mandrel.

4. A downhole tool, comprising:

a mandrel;

a lower sleeve positioned at least partially within the mandrel, wherein the lower sleeve defines a first seat that is configured to receive a first impediment, and wherein the first impediment being received within the first seat triggers a primary hydraulic release of the downhole tool from a second downhole tool in a wellbore;

an upper sleeve positioned at least partially within the mandrel, wherein the upper sleeve defines a second seat that is configured to receive a second impediment, wherein the upper sleeve is configured to move in a downward direction from a first upper sleeve position to a second upper sleeve position in response to the second impediment being received in the second seat, which triggers a secondary hydraulic release of the downhole tool from the second downhole tool in the event that the primary hydraulic release fails; and a support dog positioned at least partially around the upper sleeve, wherein the support dog is configured to move from a first support dog position to a second support dog position in response to the upper sleeve moving from the first upper sleeve position to the second upper sleeve position.

5. The downhole tool of claim 4, further comprising a collet support positioned at least partially around the support dog, wherein the collet support is configured to move from a first collet support position to a second collet support position in response to the support dog moving from the first support dog position to the second support dog position.

6. The downhole tool of claim 5, wherein the collet support defines a radial flow bypass port, wherein the radial flow bypass port is obstructed when the collet support is in the first collet support position, and wherein the radial flow bypass port is unobstructed when the collet support is in the second collet support position, thereby enabling circulation from a bore of the mandrel to an annulus outside of the downhole tool.

7. The downhole tool of claim 5, wherein the collet support defines an axial slot, wherein an alignment screw extends from the mandrel at least partially though the axial slot, wherein the alignment screw extending at least partially through the axial slot allows the collet support to move from the first collet support position to the second collet support position and prevents the collet support from rotating with respect to the mandrel.

8. The downhole tool of claim 5, wherein the support dog is positioned radially between the upper sleeve and the collet support.

9. The downhole tool of claim 8, wherein the support dog extends radially through the mandrel.

10. The downhole tool of claim 5, further comprising a collet positioned at least partially around the mandrel, wherein the collet is configured to disengage with the second downhole tool in response to the collet support moving from the first collet support position to the second collet support position.

11. A downhole tool that is configured to set a liner hanger system in a wellbore, the downhole tool comprising:

a mandrel comprising an upper portion, an intermediate portion, and a lower portion;

a lower sleeve positioned at least partially within the lower portion of the mandrel, wherein the lower sleeve defines a first seat that is configured to receive a first impediment, and wherein the first impediment being received within the first seat triggers a primary hydraulic release of the downhole tool from the liner hanger system;

an upper sleeve positioned at least partially within the intermediate portion of the mandrel, wherein the upper sleeve defines a second seat that is configured to receive a second impediment, wherein the upper sleeve is configured to move in a downward direction from a first upper sleeve position to a second upper sleeve position in response to the second impediment being received in the second seat, which triggers a secondary hydraulic release of the downhole tool from the liner hanger system in the event that the primary hydraulic release fails;

a support dog positioned at least partially around the upper sleeve, wherein the support dog is configured to move from a first support dog position to a second support dog position in response to the upper sleeve moving from the first upper sleeve position to the second upper sleeve position;

a collet support positioned at least partially around the support dog, wherein the collet support is configured to move from a first collet support position to a second collet support position in response to the support dog moving from the first support dog position to the second support dog position; and a collet positioned at least partially around the mandrel, wherein the collet is configured to disengage with the liner hanger system in response to the collet support moving from the first collet support position to the second collet support position.

12. The downhole tool of claim 11, wherein an outer surface of the upper sleeve has a larger diameter portion and a smaller diameter portion.

13. The downhole tool of claim 12, wherein the support dog extends radially through the intermediate portion of the mandrel, wherein the support dog is aligned with the larger diameter portion of the outer surface of the upper sleeve when the upper sleeve is in the first upper sleeve position, and wherein the support dog moves inward and becomes aligned with the smaller diameter portion of the outer surface of the upper sleeve when the upper sleeve is in the second upper sleeve position.

14. The downhole tool of claim 13, wherein the collet support is positioned at least partially around the intermediate portion of the mandrel, wherein the support dog engages the collet support and thereby prevents the collet support from moving in the downward direction from the first collet support position to the second collet support position when the support dog is aligned with the larger diameter portion of the outer surface of the upper sleeve, and wherein the support dog becomes disengaged with the collet support and thereby permits the collet support to move in the downward direction from the first collet support position to the second collet support position when the support dog is aligned with the smaller diameter portion of the outer surface of the upper sleeve.

15. The downhole tool of claim 14, wherein the collet support is positioned at least partially around the upper portion of the mandrel, wherein the collet is prevented from deflecting inward by the collet support when the collet support is in the first collet support position, wherein the collet is permitted to deflect inward when the collet support is in the second collet support position, and wherein the collet is configured to disengage with the liner hanger system when the collet deflects inward.

16. A method for operating a downhole tool, the method comprising:

running the downhole tool into a wellbore, wherein the downhole tool comprises:

a mandrel;

a lower sleeve positioned at least partially within the mandrel; and an upper sleeve positioned at least partially within the mandrel;

setting a second downhole tool in the wellbore using the downhole tool;

determining that a primary hydraulic release of the downhole tool from the second downhole tool has failed, wherein the primary hydraulic release involves movement of the lower sleeve but not the upper sleeve; and causing the downhole tool to release from the second downhole tool via a secondary hydraulic release in response to determining that the primary hydraulic release has failed, wherein the secondary hydraulic release involves movement of the upper sleeve but not the lower sleeve.

17. The method of claim 16, wherein causing the downhole tool to release via the secondary hydraulic release comprises:

introducing an impediment into the downhole tool, wherein the impediment is received into a seat in the upper sleeve; and increasing a pressure of a fluid in the downhole tool, wherein the upper sleeve moves in a downward direction from a first upper sleeve position to a second upper sleeve position in response to the impediment being received in the seat and the pressure increasing.

18. The method of claim 17, wherein causing the downhole tool to release via the secondary hydraulic release further comprises exerting an upward force on the mandrel after the upper sleeve moves to the second upper sleeve position, wherein a support dog that is positioned at least partially around the upper sleeve moves inward from a first support dog position to a second support dog position in response to the upward force.

19. The method of claim 18, wherein a collet support positioned at least partially around the support dog moves downward from a first collet support position to a second collet support position in response to the support dog moving to the second support dog position and the upward force.

20. The method of claim 19, wherein a collet positioned at least partially around the mandrel disengages with the second downhole tool in response to the collet support moving to the second collet support position and the upward force, and wherein the collet disengaging with the second downhole tool completes the secondary hydraulic release.

* * * * *